US006162041A

United States Patent [19]

Kobayashi

[11] Patent Number: 6,162,041

[45] Date of Patent: Dec. 19, 2000

[54] CONCRETE BLOCK FORMING APPARATUS

[76] Inventor: Shigeru Kobayashi, 401-2, Karigane-cho, Ayanokoji-sagaru, Iwagami-dori, Shimogyo-ku, Kyoto, 600-8393, Japan

[21] Appl. No.: 09/237,620

[22] Filed: Jan. 26, 1999

[30] Foreign Application Priority Data

Oct. 26, 1998 [JP] Japan ..... 10-303987

[51] Int. Cl.[7] ..... B28B 1/087

[52] U.S. Cl. ..... 425/421; 425/432

[58] Field of Search ..... 425/432, 456, 425/421, 211; 264/71

[56] References Cited

U.S. PATENT DOCUMENTS

| | | | |
|---|---|---|---|
| 2,095,299 | 10/1937 | Thweatt et al. | 18/17 |
| 3,277,551 | 10/1966 | Sekiguchi | 25/41 |
| 3,832,119 | 8/1974 | Woelk | 425/432 |
| 4,111,627 | 9/1978 | Kitahara | 425/421 |
| 4,332,540 | 6/1982 | Van de Caveye | 425/182 |
| 4,561,626 | 12/1985 | Black | 249/118 |
| 4,795,334 | 1/1989 | Kitahara | 425/88 |
| 5,314,323 | 5/1994 | Bolles | 425/186 |
| 5,620,718 | 4/1997 | Bohm | 425/190 |
| 5,846,576 | 12/1998 | Braungardt | 425/253 |

FOREIGN PATENT DOCUMENTS 3-17641 3/1991 Japan .

*Primary Examiner*—James P. Mackey
*Assistant Examiner*—Joseph S. Del Sole
*Attorney, Agent, or Firm*—Flynn, Thiel, Boutell & Tanis, P.C.

[57] ABSTRACT

A concrete block forming apparatus comprising a receiving plate (5) supported above a machine frame table (2) through an elastic body (4), a form (6) mounted on an upper surface of the receiving plate (5), a vibrator (3) for applying a vibration to the form (6), a press machine (9) descending from an upper portion of the form (6), and a lock mechanism (10) for clamping or unclamping the elastic body (4). The concrete block forming apparatus provides concrete blocks with an even height without breakage thereof.

3 Claims, 4 Drawing Sheets

CONCRETE BLOCK FORMING APPARATUS

BACKGROUND OF THE INVENTION

1. Field of the Invention

The invention relates to a concrete block forming apparatus which supplies a concrete material to a form, and pressurizes as well as applies a vibration so as to form a concrete block.

2. Description of the Prior Art

When forming a concrete block, it has been a general practice to support a receiving plate through an elastic body such as a rubber above a machine frame table provided in a main body of a forming apparatus, supply a concrete material to a form mounted on an upper surface of the receiving plate, apply a vibration to the concrete material supplied to the form, consolidate the concrete material within the form by a press machine and thereafter release the concrete material from the form.

However, a strong vibration and a pressurizing are necessary in order to obtain a strong concrete block, accordingly, a strong vibration and a pressure are applied to the elastic body such as a rubber for supporting the receiving plate, so that the elastic body becomes in a compression state, and the elastic body expands by being restored to the original state when removing a pressurizing force for releasing the mold, as a result, there is a case that a height of the formed concrete block becomes uneven, causing defective or broken products.

SUMMARY OF THE INVENTION

The invention is made so as to solve the problems mentioned above, and an object of the invention is to provide a concrete block forming apparatus which prevents uneven heights and breakage of concrete blocks.

In accordance with a first aspect of the invention, there is provided a concrete block forming apparatus comprising a receiving plate supported above a machine frame table through an elastic body, a form mounted on an upper surface of the receiving plate, a vibrator for applying a vibration to the form, a press machine descending from the upper portion of the form, and a lock mechanism for clamping or unclamping the elastic body. Accordingly, since the lock mechanism clamps the elastic body at a time of finishing the vibration excitation and the pressurization, a restoration and expansion of the elastic body are restricted, and the height of the concrete block can be prevented from becoming uneven and its breakage can be prevented.

In accordance with a second aspect of the invention, there is provided a concrete block forming apparatus as set forth in the first aspect, wherein the machine frame table is fixed to the main body of the forming apparatus, the form is arranged in such a manner as to move upwardly and downwardly with respect to the receiving plate, and the vibrator is mounted to the machine frame table. Accordingly, the height of the concrete block can be prevented from becoming uneven and its breakage can be prevented by the concrete block forming apparatus in which the machine frame table is fixed.

In accordance with a third aspect of the invention, there is provided a concrete block forming apparatus as set forth in the first aspect, wherein the machine frame table is arranged in such a manner as to move upward and downward with respect to a main body of the forming apparatus, the form is mounted to the main body of the forming apparatus through a buffer, and the vibrator is mounted to the form. Accordingly, the height of the concrete block can be prevented from becoming uneven and its breakage can be prevented by the concrete block forming apparatus in which the machine frame table is moved upward and downward.

In accordance with a fourth aspect of the invention, there is provided a concrete block forming apparatus as set forth in the first aspect, wherein a plurality of oil hydraulic or air cylinders are provided in a table mechanism as a lock mechanism for clamping and unclamping the elastic body to permit connection to an upper table through the elastic body. Accordingly, the oil hydraulic or air cylinders are made free until applying the vibration and pressure and an oil hydraulic pressure or an air pressure is applied only when locking.

In accordance with a fifth aspect of the invention, there is provided a concrete block forming apparatus as set forth in the first aspect, wherein the lock mechanism comprises a cylinder fixed to the machine frame table, a rod slidably extending through the cylinder and fixed to the receiving plate at an end, a cam for clamping or unclamping the rod, and a wedge for bringing the cam in a clamped state on receiving an urging force of a spring and bringing the cam in an unclamped state by supply of a pressurized fluid resisting against the urging force of the spring. When the pressurized fluid is not supplied to the cylinder, the cam becomes in an unclamped state for making the rod slidable by a spring force, and when the pressurized fluid is supplied to the cylinder, the wedge brings the cam in a clamped state against the spring force so as to prevent the rod from sliding, thereby keeping the elastic body in a compressed state.

DETAILED DESCRIPTION OF THE PREFERRED EMBODIMENTS

An embodiment in accordance with the invention will be described below with reference to the accompanying drawings.

Figure 1:
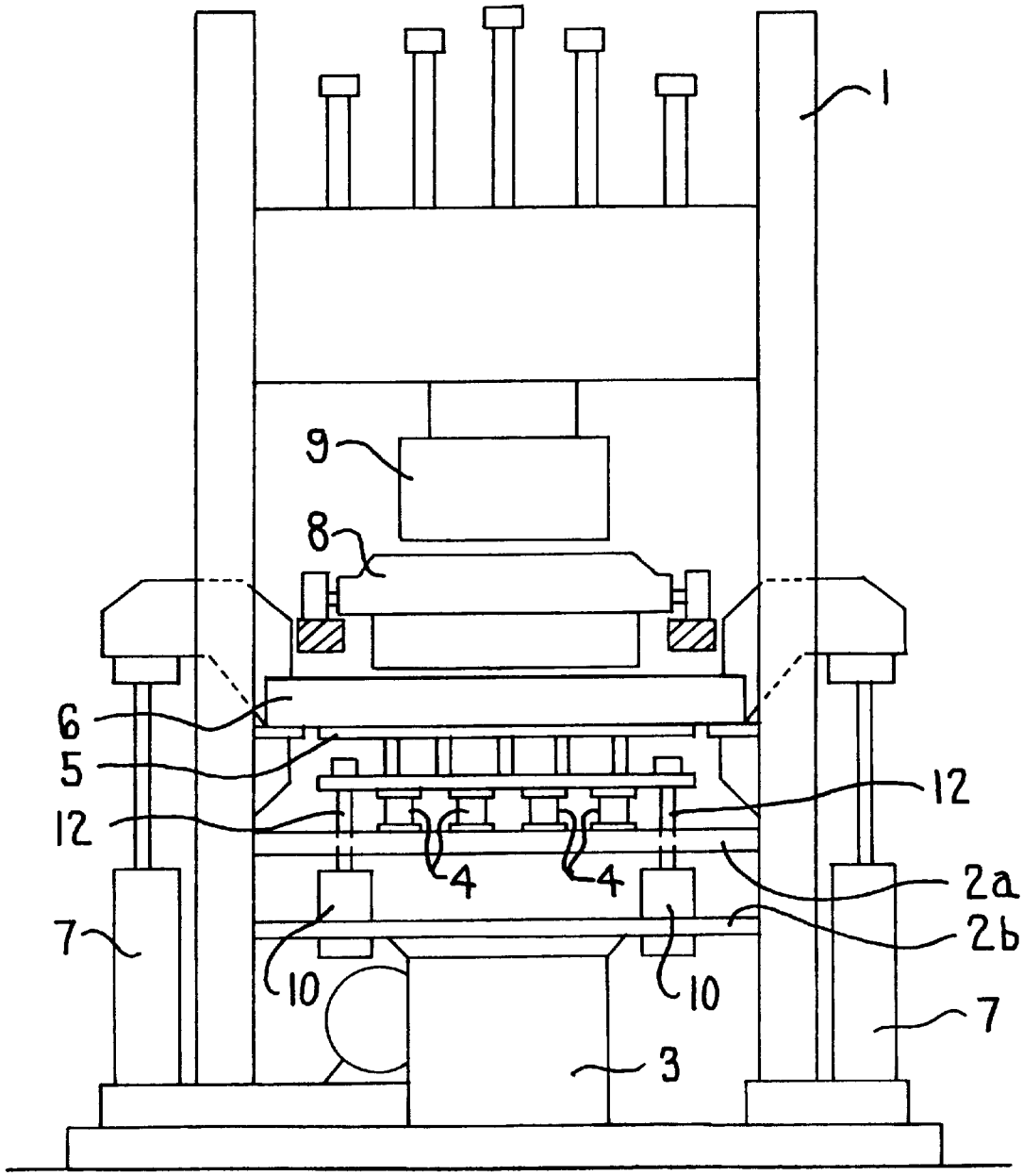
FIG. 1 is a front view which shows an embodiment in accordance with the invention.

FIG. 1 is a front view which shows an embodiment in accordance with the invention. Machine frame tables 2*a* and 2*b* are horizontally fixed to a lower portion of a main body 1 of a concrete block forming apparatus, a vibrator 3 is mounted to a lower surface of the machine frame table 2*b* and a receiving plate 5 is supported to an upper surface side of the machine frame table 2*a* through a multiplicity of elastic bodies 4 such as rubbers.

A form 6 is arranged on an upper surface side of the receiving plate 5, and the form 6 is structured such as to move upward and downward with respect to the receiving plate 5 due to an expansion and contraction of a cylinder apparatus 7. Then, a material supply box 8 is advancingly arranged above the form 6, and a press machine 9 moving downward to the form 6 is provided above the same.

A lock mechanism 10 described below is provided between the machine frame table 2*b* and the receiving plate 5 mentioned above.

Figure 3:
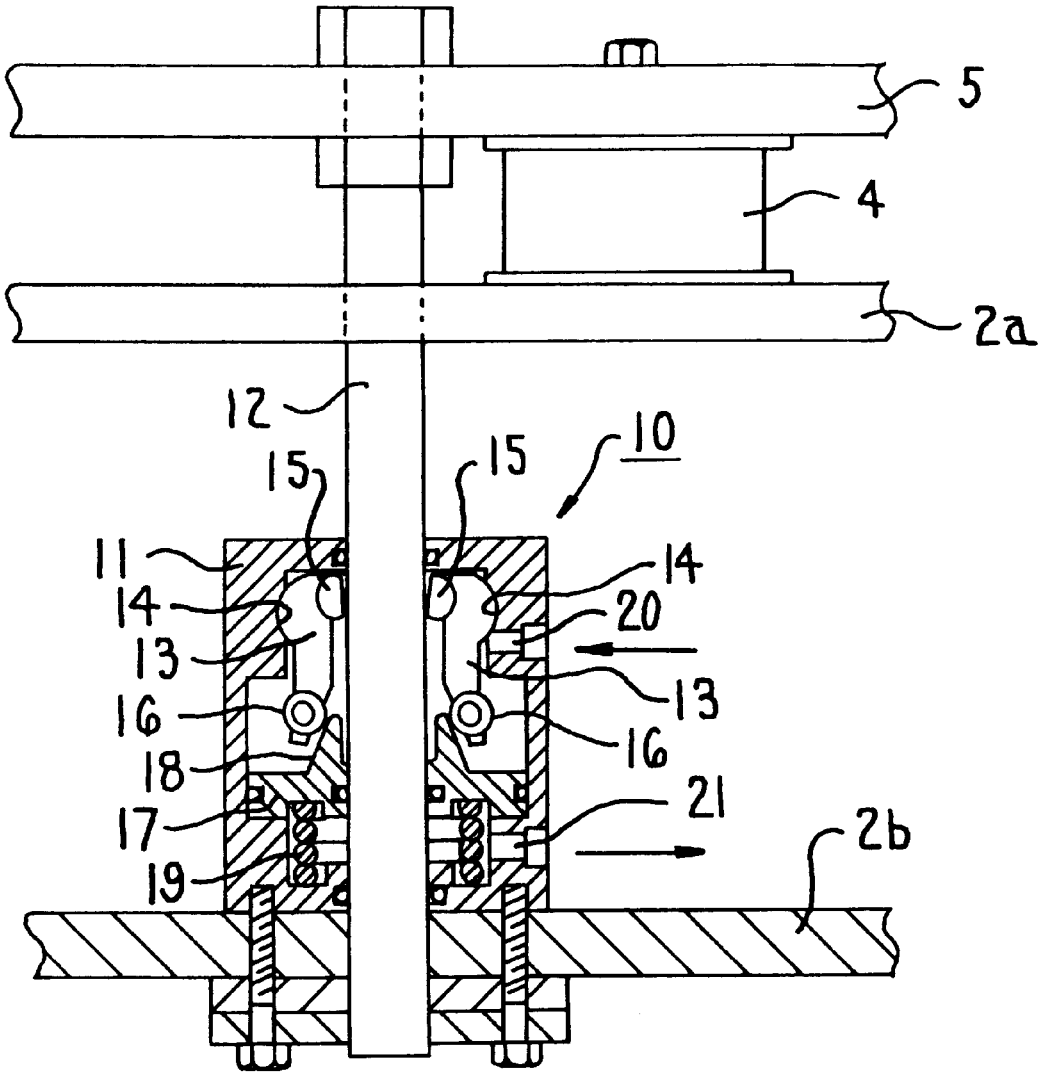
FIG. 3 is a vertical cross sectional view which shows an embodiment of a lock mechanism used in the invention.

FIG. 3 is a vertical cross sectional view which shows an embodiment of the lock mechanism 10 used in the invention, and the lock mechanism 10 is provided with a cylinder 11 fixed to the machine frame table 2*b* and a perpendicular rod 12 slidably extends through a center portion of the cylinder 11. The rod 12 slidably extends through the machine frame tables 2*a* and 2*b*, and an upper end of the rod 12 is fixed to the receiving plate 5.

Above an inner portion of the cylinder 11, a plurality of cams 13 are arranged in the periphery of the rod 12, and each of the cams 13 is supported on a recess-like supporting point 14 formed in the inner portion of the cylinder 11 and is structured so as to rotate around the supporting point 14 in a perpendicular direction. Then, a shoe 15 is fixed to an upper end of the cam 13 in such a manner as to oppose to a surface of the rod 12, and a roller 16 is rotatably mounted to a lower end of the cam 13.

A piston 17 slidably passing the rod 12 therethrough is fitted to a lower portion in the inner portion of the cylinder 11, and a conical wedge 18 is formed on an upper surface of the piston 17 around the rod 12.

A spring 19 is interposed between a lower surface of the piston 17 and a bottom surface of the cylinder 11, and always urges the piston 17 upward. Further, a supply and discharge port 20 is provided near an upper end portion of the cylinder 11, and a supply and discharge port 21 is provided near a lower end portion of the cylinder 11, so that the structure is made such that when a pressurized fluid such as a pressurized air is supplied to one of the supply and discharge ports 20 and 21, the pressurized fluid is discharged from the other thereof.

Next, the operation of the concrete block forming apparatus shown in FIG. 1 will be described below.

When forming a concrete block in the apparatus shown in FIG. 1, in the lock mechanism 10 provided between the machine frame table 2*b* and the receiving plate 5, a state is set such that the pressurized fluid is supplied to the supply and discharge port 20 above the cylinder 11 as shown in FIG. 3 and the pressurized fluid is discharged from the lower supply and discharge port 21.

Accordingly, the piston 17 is pressed down against a force of the spring 19, the wedge 18 formed on an upper surface of the piston 17 tends to move away from the roller 16 so that the cam 13 is in a free state, the shoe 15 fixed to the upper end of the cam 13 tends to move away from the surface of the rod 12, and the rod 12 is in a state of sliding and displacing with respect to the cylinder 11.

In this state, the cylinder apparatus 7 shown in FIG. 1 is retracted so as to mount the form 6 on the upper surface of the receiving plate 5, a predetermined amount of concrete material is supplied to the form 6 from the material supply box 8 by advancing the material supply box 8 above the form 6, and thereafter the material supply box 8 is moved out from the upper portion of the form 6.

Next, when the vibrator 3 is operated, the vibration is transmitted to the form 6 through the machine frame table 2*b*, the main body 1, the machine frame table 2*a*, the elastic body 4 and the receiving plate 5, thereby making the concrete material supplied to an inner portion of the form 6 compact. Further, when lowering the press machine 9 so as to pressurize the concrete material supplied to the inner portion of the form 6 and make it compact, the receiving plate 5 is also pressurized and descended and the elastic body 4 on the lower surface of the receiving plate 5 becomes in a compressed state.

Figure 4:
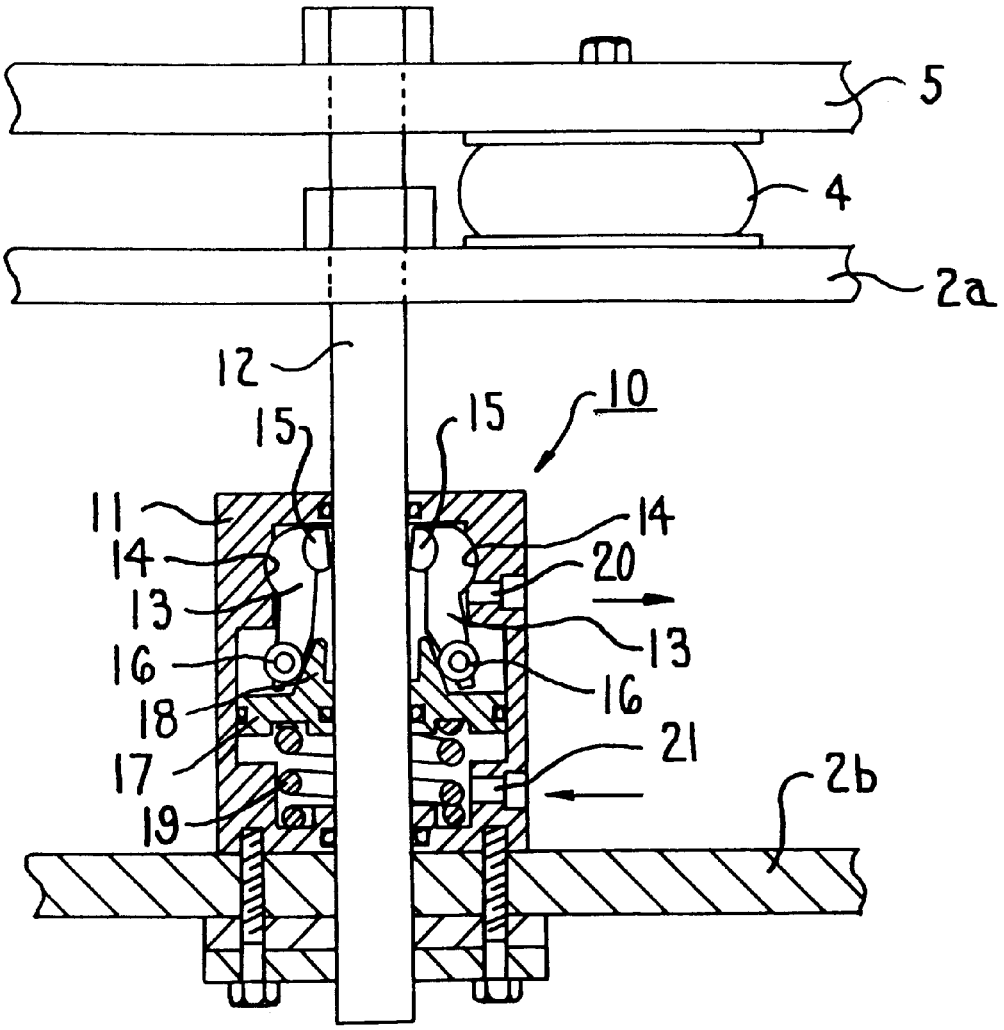
FIG. 4 is a vertical cross sectional view which shows a state different from that of FIG. 3.

When the elastic body 4 is compressed by a predetermined dimension, a standard dimension detecting sensor (not shown) is operated, so that as shown in FIG. 4, the pressurized fluid is discharged from the supply and discharge port 20 above the cylinder 11 and the pressurized fluid is supplied to the lower supply and discharge port 21.

Accordingly, the piston 17 ascends due to the force of the spring 19, the upper end of the wedge 18 formed on the piston 17 enters between the rod 12 and the roller 16, thereby pressing and moving the lower end of the cam 13 in a direction of moving away from the rod 12, rotating the cam 13 around the supporting point 14 so as to press the shoe 15 to the surface of the rod 12 and restricting the rod 12 so as not to slide and displace with respect to the cylinder 11.

Accordingly, the motion of the receiving plate 5 is restricted and the elastic body 4 is restricted in a compressed state, so that even when the pressurizing force on the receiving plate 5 is reduced, the elastic body 4 is not restored and expanded.

In this state, when raising the form 6 shown in FIG. 1 and releasing the pressurized concrete material from the mold, the concrete block with a high quality can be obtained without any unevenness in height and breaking.

After being released from the mold, as shown in FIG. 3, the pressurized fluid is supplied to the supply and discharge port 20 so as to discharge the pressurized fluid from the supply and discharge port 21, thereby bringing the rod 12 in a state of slidably displacing with respect to the cylinder 11 so as to restore and expand the elastic body 4, and subsequently proceeding to the supply material for forming the next concrete block.

Figure 2:
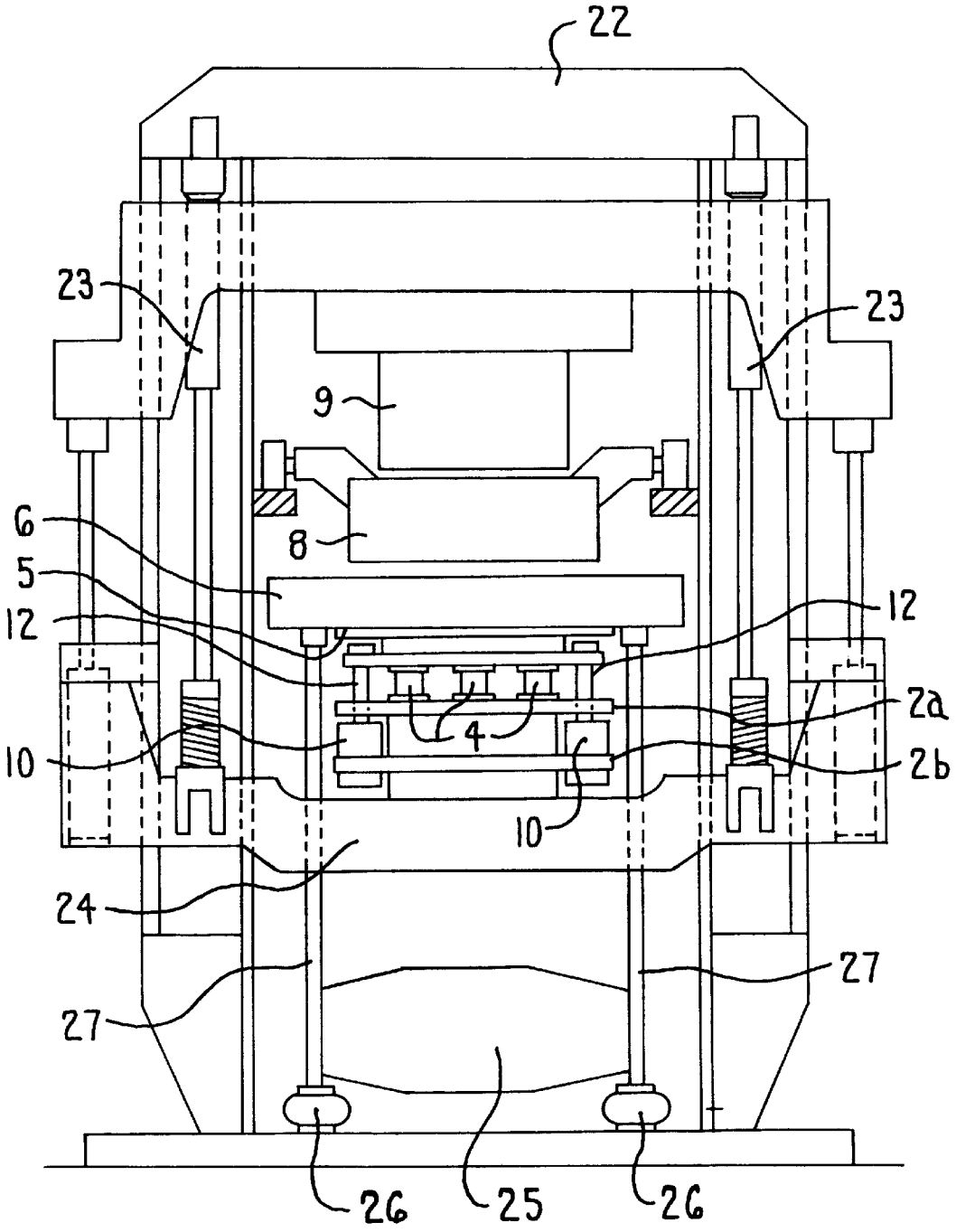
FIG. 2 is a front view which shows another embodiment in accordance with the invention.

FIG. 2 is a front view which shows another embodiment in accordance with the invention. An upward and downward moving frame body 24 structured such as to be moved upward and downward by a cylinder apparatus 23 mounted to a main body 22 of a concrete block forming apparatus is arranged and the machine frame tables 2*a* and 2*b* are horizontally fixed to an upper portion of the upward and downward moving frame body 24.

The receiving plate 5 is supported on the upper surface side of the machine frame table 2*a* through a multiplicity of elastic bodies 4 such as rubbers. In the upper surface side of the receiving plate 5, the form 6 is arranged by a form support rod 27 provided with a vibrator 25 and mounted on a buffer 26, such as an air spring. Then, the material supply box 8 is arranged above the form 6 in such a manner as to advance, and further, the press machine 9 for moving downward to the form 6 is provided above the same. Further, the lock mechanism 10 described in FIGS. 3 and 4 is provided between the machine frame table 2*b* and the receiving plate 5.

Also, when forming the concrete block in the apparatus shown in FIG. 2, the concrete material is supplied to the inner portion of the form 6 in a state of the lock mechanism 10 being unlocked, the vibration due to the vibrator 25 is applied to the form 6, the press machine 9 is moved downward so as to pressurize the concrete material to a compact state, the rod 12 is restricted so that the elastic body 4 is compressed by a predetermined dimension, and the receiving plate 5 is moved downward together with the upward and downward moving body 24 so as to be released from the mold. Accordingly, a concrete block with a high quality can be obtained without any unevenness in height and breaking.

In accordance with the invention as stated in the first aspect, there is an effect that a restoration and expansion of the elastic body are restricted, and an uneven height of the concrete block can be prevented and the breakage can be prevented by clamping the elastic body by means of the lock mechanism at a time of finishing the vibration excitation and the pressurization.

In accordance with the invention as stated in the second aspect, there is an effect that the height of the concrete block can be prevented from becoming uneven and the breakage can be prevented by the concrete block forming apparatus in which the machine frame table is fixed.

In accordance with the invention as stated in the third aspect, there is an effect that the height of the concrete block can be prevented from becoming uneven and breakage can be prevented by the concrete block forming apparatus in which the machine frame table is moved upward and downward.

In accordance with the invention as stated in the fourth aspect, there is an effect that the elastic body is prevented from being restored and expanded by a compact apparatus controlled in accordance with a pressurized fluid and the height of the concrete block can be prevented from becoming uneven and the breakage can be prevented.

What is claimed is:

1. A concrete block forming apparatus comprising a machine frame table having an upper frame table and a lower frame table; a receiving plate supported above the upper frame table by an elastic body; a form mounted on an upper surface of said receiving plate, a vibrator for applying vibration to said form; a press mounted for descent into said form; a hydraulic cylinder for raising and lowering said press; and a lock mechanism for clamping said elastic body downwardly onto the upper frame table or unclamping said elastic body, said lock mechanism comprising a plurality of oil hydraulic or air cylinders mounted on the lower frame table, a rod slidably extending through said cylinder and mounted to the receiving plate, a cam for clamping or unclamping said rod, a wedge for bringing the cam into a clamped state, a spring for urging the wedge towards the cam and bringing the cam into the clamped state and a pressurized fluid inlet for introducing a pressurized fluid for acting against the spring and bringing the cam into an unclamped state.

2. The concrete block forming apparatus of claim 1, wherein the machine frame table is fixed to a main frame of the concrete block forming apparatus, the form is movable upwardly and downwardly relative to the receiving plate and the vibrator is attached to the machine frame table.

3. The concrete block forming apparatus of claim 1, wherein the machine frame table is movable upwardly and downwardly relative to a main frame of the concrete block forming apparatus, the form is attached to the main frame through a buffer and the vibrator is attached to the form.

* * * * *